US010674814B2

(12) United States Patent
Nakatani

(10) Patent No.: US 10,674,814 B2
(45) Date of Patent: Jun. 9, 2020

(54) SUPPORT DEVICE

(71) Applicant: VELBON KABUSHIKI KAISHA, Tokyo (JP)

(72) Inventor: Koichiro Nakatani, Tokyo (JP)

(73) Assignee: VELBON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/232,276

(22) Filed: Dec. 26, 2018

(65) Prior Publication Data

US 2019/0200754 A1 Jul. 4, 2019

(30) Foreign Application Priority Data

Dec. 28, 2017 (JP) ..... 2017-253736

(51) Int. Cl.
*A47B 19/00* (2006.01)

(52) U.S. Cl.
CPC ..... *A47B 19/002* (2013.01); *A47B 2019/004* (2013.01); *A47B 2019/008* (2013.01)

(58) Field of Classification Search
USPC ..... 248/464
See application file for complete search history.

(56) References Cited

U.S. PATENT DOCUMENTS 2,547,924 A * 4/1951 Citro ..... G10G 5/00 84/327
4,650,145 A * 3/1987 Natzel ..... F16M 11/28 248/188.5
5,072,910 A * 12/1991 May ..... F16M 11/28 248/170
5,125,613 A * 6/1992 Albee, Jr. ..... A47B 97/08 248/463
D344,969 S * 3/1994 Nakatani ..... D16/244
5,746,407 A * 5/1998 Nakatani ..... F16M 11/18 248/168
5,918,997 A * 7/1999 Hsieh ..... A47B 19/002 403/104
5,979,856 A * 11/1999 Hsu ..... A47B 19/002 248/441.1
6,193,204 B1 * 2/2001 Hsu ..... A47B 19/002 248/441.1
6,491,266 B1 * 12/2002 Chen ..... F16M 11/16 248/163.1

(Continued)

FOREIGN PATENT DOCUMENTS

JP 3010269 U 4/1995
JP 2002-169542 A 6/2002

(Continued)

*Primary Examiner* — Monica E Millner
(74) *Attorney, Agent, or Firm* — Troutman Sanders LLP

(57) ABSTRACT

To provide a support device having preferable operability.

A music stand includes a support body supporting a music. A movable body is provided at a support column of the support body to be movable. A fixed body is provided at a lower end portion of the support column. A leg body is fitted to the movable body to be rotatable. The fixed body and the leg body are connected with a connection body. The movable body has three leg fitting projections arranged in a peripheral direction of the movable body main body part. The leg body has facing portions separately facing each other with the leg fitting projection interposed.

10 Claims, 10 Drawing Sheets

(56) References Cited

U.S. PATENT DOCUMENTS 6,609,686 B2 * 8/2003 Malizia ..... F16B 7/1409 248/125.8
7,080,814 B1 * 7/2006 Brooks ..... A45C 13/385 248/441.1
7,204,466 B2 * 4/2007 Hsieh ..... F16B 7/105 248/157
7,438,266 B2 * 10/2008 May ..... F16M 11/34 248/163.1
7,552,900 B2 * 6/2009 Yoon ..... A47B 9/083 248/157
7,703,725 B2 * 4/2010 May ..... G10D 13/026 248/163.1
7,718,878 B2 * 5/2010 May ..... F16M 11/34 84/422.1
8,262,049 B2 * 9/2012 Evanoff ..... A47B 19/002 211/135
8,633,365 B2 * 1/2014 May ..... G10D 13/026 84/387 A
8,664,500 B2 * 3/2014 Shimada ..... F16M 11/245 248/170
8,915,476 B2 * 12/2014 Nakatani ..... F16M 11/105 248/163.1
9,377,158 B2 * 6/2016 May ..... A47B 19/002
9,863,573 B2 * 1/2018 May ..... F16M 11/245
2003/0052237 A1 * 3/2003 Yu ..... A47B 19/002 248/125.8
2006/0086869 A1 * 4/2006 Hsieh ..... F16M 11/046 248/171
2008/0078734 A1 4/2008 Yoon
2014/0301730 A1 * 10/2014 Johnson ..... G03B 17/561 396/428
2016/0061377 A1 * 3/2016 Nakatani ..... F16M 11/242 248/184.1
2016/0077412 A1 * 3/2016 Nakatani ..... F16B 7/149 403/377

FOREIGN PATENT DOCUMENTS

JP 2016-218283 A 12/2016
JP 2017-020566 A 1/2017

* cited by examiner

SUPPORT DEVICE

INCORPORATION BY REFERENCE

The present invention claims priority under 35 U.S.C. § 119 to Japanese Patent Application No. 2017-253736 filed on Dec. 28, 2017. The content of the application is incorporated herein by reference in their entirety.

FIELD OF THE INVENTION

The present invention relates to a support device with preferable operability.

BACKGROUND OF THE INVENTION

Conventionally, there is known a support device (music stand) described in the following PTL1, for example.

The conventional support device includes a fixed seat fixed to the proximity or an end or a support column and a movable seat sliding on the support column, a leg having one end pivotally attached to the fixed seat to be reversible, and a transmission rod having one end pivotally attached to the leg and the other end pivotally attached to the movable seat to be displaceable, in which at a folding completion position, a line linking a pivotally attached point between the leg and the fixed seat and a pivotally attached point between the transmission rod and the movable seat is provided to be parallel to an axis line of the support column, and the pivotally attached point between the leg and the transmission rod sandwiching the line is positioned on the opposite side of an axis line of the support column.

CITATION LIST

Patent Literature

PTL 1: Japanese Laid-open Patent Publication No. 2002-169542

SUMMARY OF INVENTION

Technical Problem

In addition, for such a support device, there is desired one that a user can operate easily, and operability is demanded to be preferable.

In view of such aspects, the present invention aims at providing a support device with preferable operability.

Solution to Problem

A support device according to the present invention has a support body that supports a supported object, a movable body that is provided in the support body to be movable, a fixed body that is provided in the support body, a leg body that is fitted to the movable body to be rotatable with a rotation center axis as a center, and a connection body with one end side connected to the leg body to be rotatable and other end side connected to the fixed body to be rotatable, in which the movable body includes a movable body main body part having an insertion hole formed therein with the support body inserted in the insertion hole, and a leg fitting projection provided on the movable body main body part and having a through hole formed therein, the leg body having a longitudinal leg part, and facing portions provided in the leg part, having an axis penetration hole formed therein, and separately facing each other with the leg fitting projection interposed, and the rotation center axis is penetrated in the through hole of the leg fitting projection and the axis penetration hole of each of the facing portions.

Advantageous Effects of Invention

According to the present invention, preferable operability is preferable, and a user can operate easily.

DETAILED DESCRIPTION OF THE PREFERRED EMBODIMENT

An embodiment of the present invention will be described with reference to FIG. 1 to FIG. 10.

Figure 1:
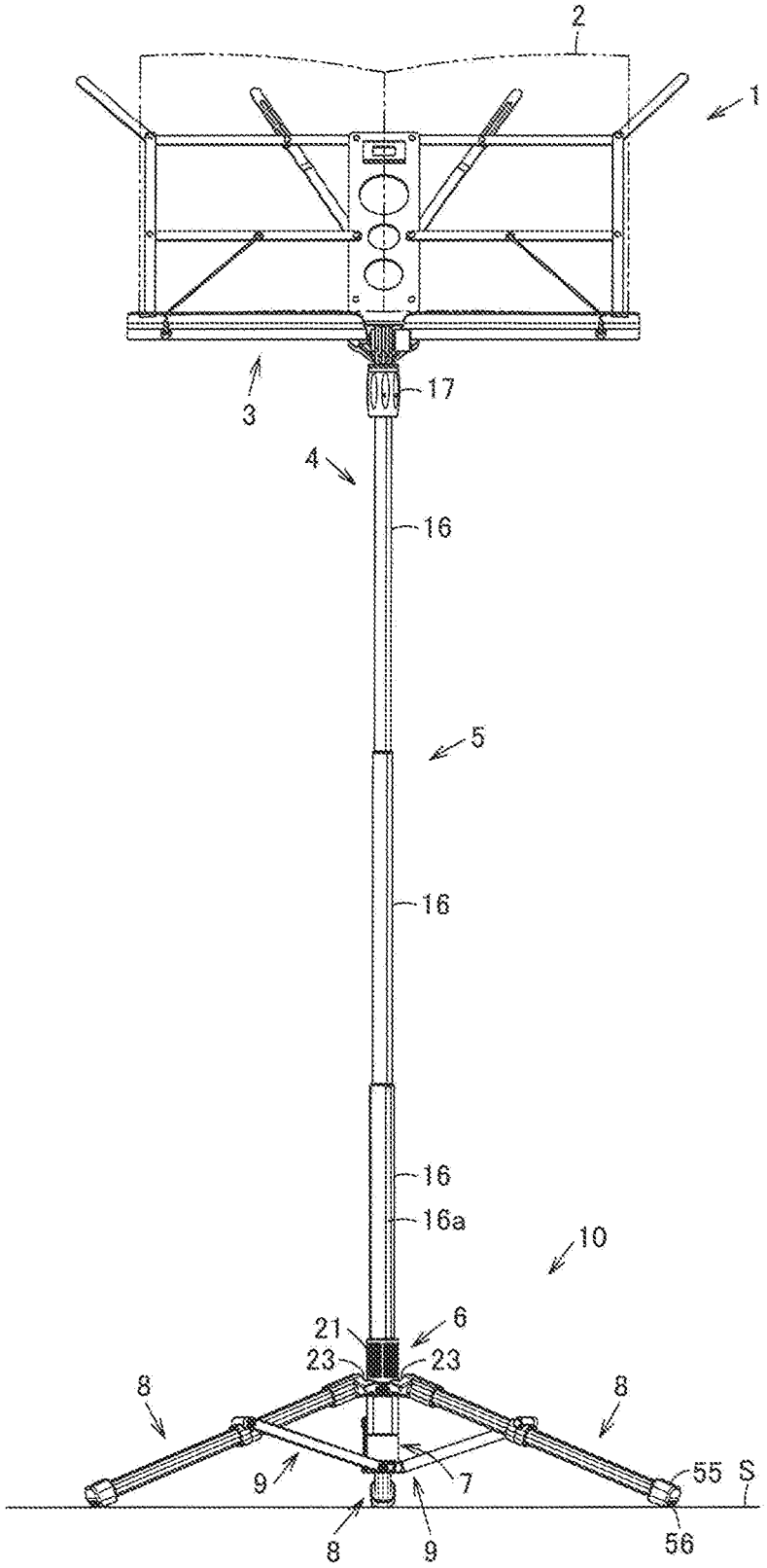
FIG. 1 is a front view of a music stand that is a support device according to an embodiment of the present invention, when it is used.
Figure 2:
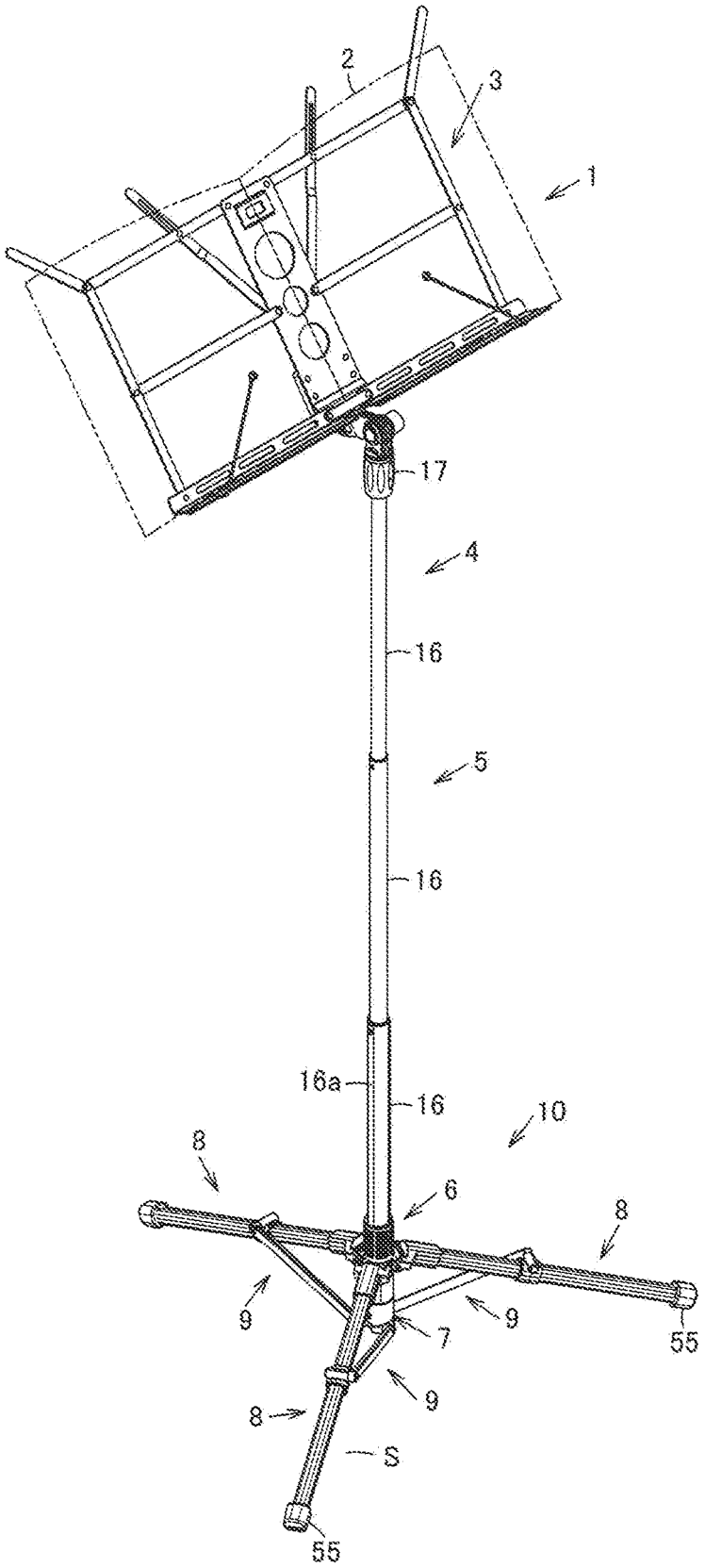
FIG. 2 is a perspective view of the music stand when it is used.
Figure 3:
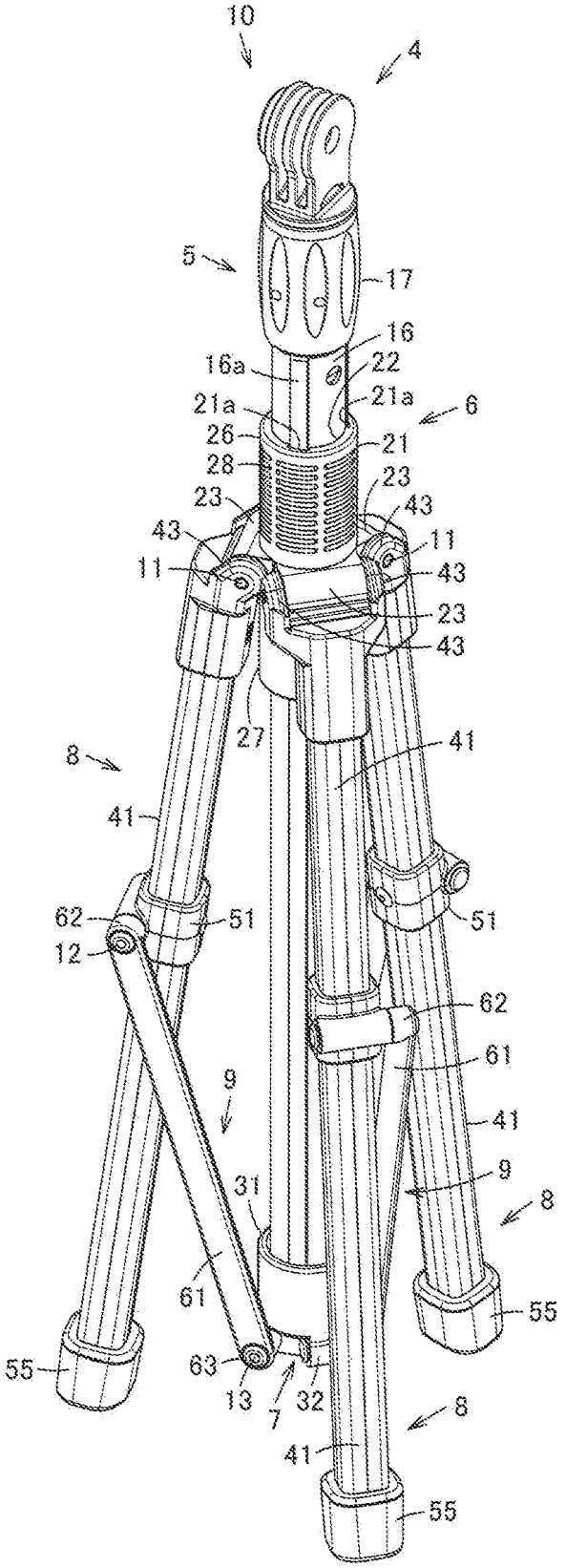
FIG. 3 is a perspective view of a tripod of the music stand.
Figure 4:
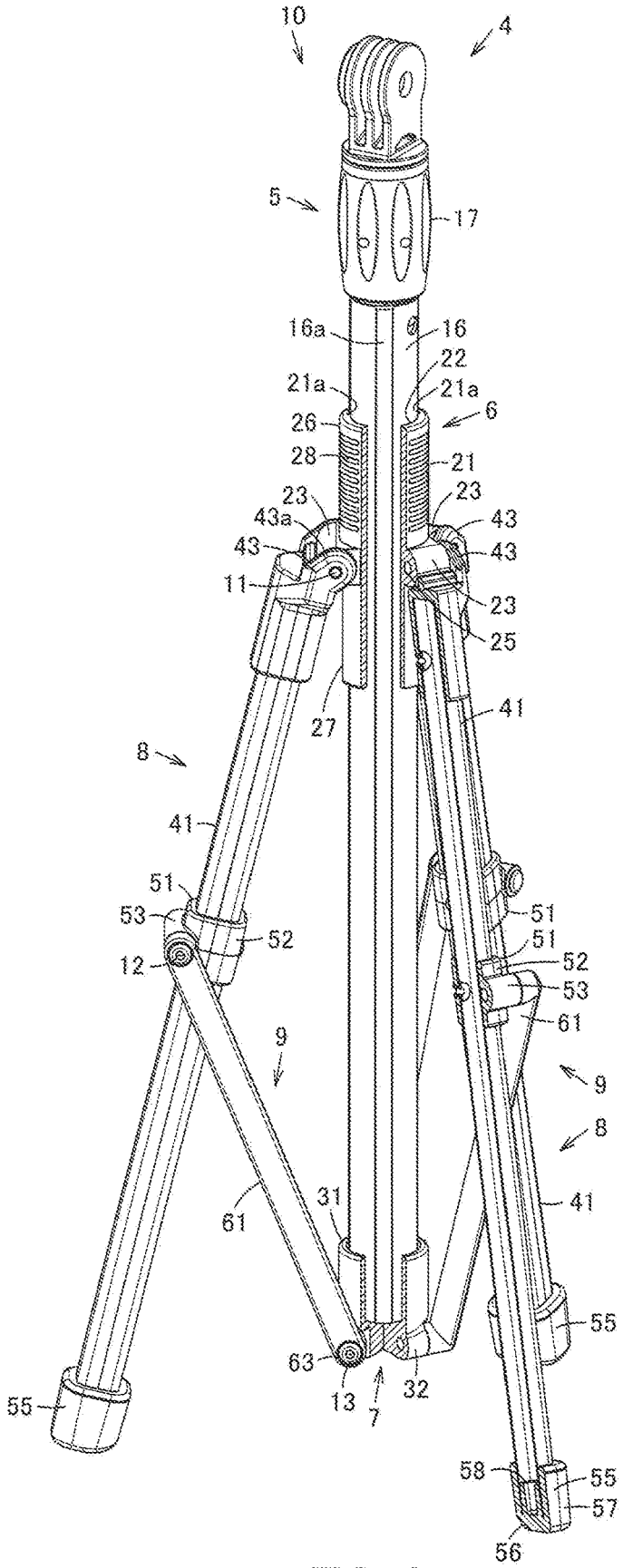
FIG. 4 is a partially cutout perspective view of the tripod of the music stand.

In FIG. 1 and FIG. 2, the reference sign 1 represents a music stand that is a foldable support device, and the music stand 1 is placed on a placement surface S in a desired use state when it is used, so as to support a music 2 that is a supported object. Note that when the music stand 1 is not used when carrying or the like, the music stand 1 can be folded to be in a compact nonuse state (folded state).

The music stand 1 includes a support body 5 having a foldable music support frame 3 supporting the music 2 and an extensible and contractible support column (extensible and contractible column part) 4 longitudinal in an up-and-down direction and having an upper end portion to which the music support frame 3 is fitted to be removable and attachable, a movable body 6 provided at the support column 4 of the support body 5 to be slidable in an up-and-down direction along an outer peripheral surface of the support column 4, and a fixed body 1 secured to a lower end portion of the support column 4.

Moreover, the music stand 1 includes three longitudinal leg bodies 8 fitted to the movable body 6 to be rotatable in a given rotation range (in a rotation range of smaller than 90°, for example) with a rotation center axis (rotation fulcrum P1) 11 in a horizontal direction as a center, and three (same as the number of leg bodies 8) longitudinal connection bodies 9 with an upper end side as one end side connected to a longitudinal direction center part (including a substantially center part, which also applies hereinafter) as a longitudinal direction intermediate part of the leg bodies 8 to be rotatable with a rotation center axis (rotation fulcrum P2) 12 in a horizontal direction as a center, and with a lower end side as the other end side connected to the fixed body 7 to be rotatable with a rotation center axis (rotation fulcrum P3) 13 in a horizontal direction as a center.

Note that a foldable tripod (tripod for music stand) 10 is constituted by one support column (extensible and contractible column) 4, one cylindrical movable body (movable cylinder) 6, one bottomed cylindrical fixed body (fixed cylinder) 7, three leg bodies 8, and three connection bodies (connection rods) 9.

The support column 4 enables, by adjusting the length thereof in an up-and-down direction, adjustment of a height position of the music support frame 3, and has a plurality of stages in which an upper stage has a smaller outer diameter, that is, three-stage tubular members 16, for example. A fitting member 17 is fastened to an upper end portion of the tubular member 16 of the highest stage, and the music support frame 3 is fitted to the fitting member 17 to be removable and attachable. The fixed body 7 is fitted and fastened from the lower side to the lower end portion of the tubular member 16 of the lowest stage.

The movable body 6 is provided to be slidable on the outer peripheral side of the support column 4. As illustrated in FIGS. 3 to 9 or the like, for example, the movable body 6 has a cylindrical movable body main body part 21 having open upper and lower surfaces, and the support column 4 of the support body 5 is inserted to the inner peripheral side of the movable body main body part 21. That is, the movable body main body part 21 has an insertion hole 22 going through the upper and lower surfaces thereof, and the tubular member 16 of the lowest stage of the support column 4 is inserted to the insertion hole 22. Then, the movable body main body part 21 moves slidely (slides) in an up-and-down direction along the outer peripheral surface of the tubular member (guiding cylinder) 16 of the lowest stage while being guided by projected stripes 16*a*. The inner peripheral surface of the movable body main body part 21 has three recessed grooves 21*a* extending in an up-and-down direction, and the projected stripes 16*a* for rotation lock are fitted to each of the recessed grooves 21*a* to be slidable. Note that the recess and projection may be reversed, and the structure may be such that the projected stripes are formed on the inner peripheral surface of the movable body main body part 21, and the recessed grooves 21*a* are formed on the outer peripheral surface of the tubular member 16, or the like.

Moreover, on an up-and-down direction center part that is an up-and-down direction intermediate part (axis direction intermediate part) of the movable body main body part 21, three leg fitting projections 23, arranged in a peripheral direction of the movable body main body part 21 with a slight gap between the mutually adjacent leg fitting projections 23, are provided integrally to project outward in a radial direction. Each of the leg fitting projections 23 is formed to have a substantially semicylindrical shape with a substantially semicircular cross section, and has an arc surface 24 on the surface thereof. Each of the leg fitting projections 23 has a long-hole-shaped through hole 25 having a circular section and extending in a horizontal direction that is formed to go through both end surfaces thereof.

Then, a distance A between a longitudinal direction center part of the through hole 25 of the leg fitting projection 23 and the insertion hole 22 of the movable body main body part 21 (smallest distance between the through hole 25 and the insertion hole 22) is shorter than a thickness B of a portion positioned between the mutually adjacent leg fitting projections 23 of the movable body main body part 21 (portion neighboring to the leg fitting projection in a peripheral direction of the movable body main body part 21). That is, the through hole 25 is formed close to the insertion hole 22 side and positioned at a position near the insertion hole 22. Note that the distance A shorter than the thickness B is ideally 0 mm. However, considering the moldability of the movable body main body part 21 created by injection molding, it is preferable to allow at least 2 mm.

Moreover, a longitudinal direction length dimension L of the through hole 25 of the leg fitting projection 23 is longer than a diameter D of the insertion hole 22 of the movable body main body part 21 (diameter of a portion where no recessed groove 21*a* is formed). Note that the diameter D or the long-hole-shaped insertion hole 22 having a circular section and extending in an up-and-down direction is an inner diameter of a portion where the leg fitting projections 23 are provided in the movable body main body part 21, as illustrated in FIG. 7.

Figure 7:
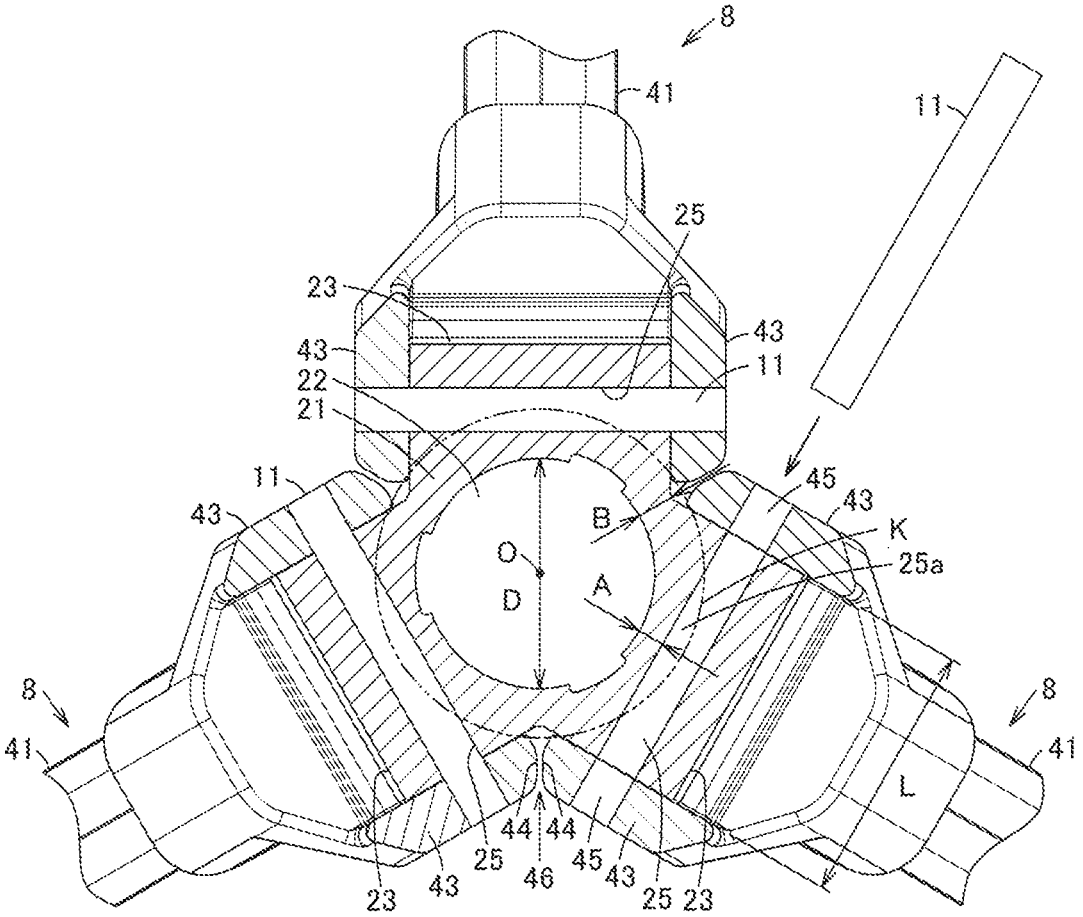
FIG. 7 is a main part section view of the music stand.
Figure 8A:
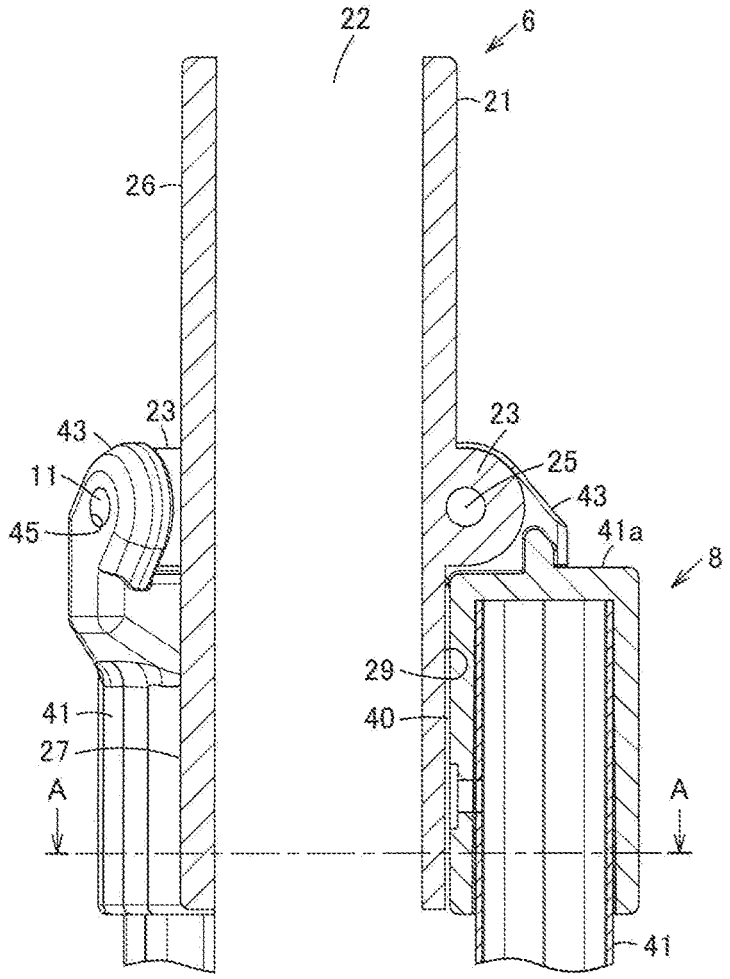
FIGS. 8A and 8B are main part section views of the music stand.
Figure 8B:
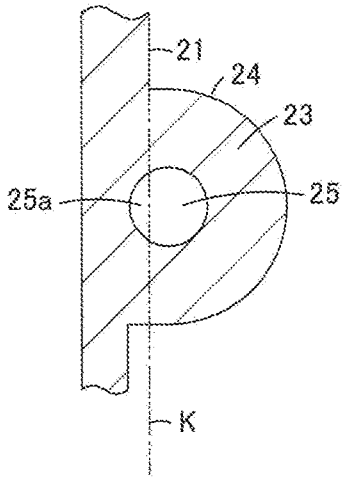
Figure 9:
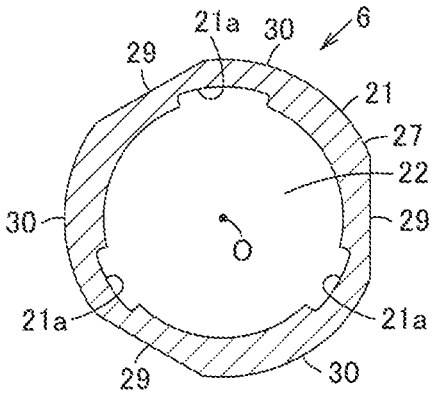
FIG. 9 is a section view of a movable body, viewed along A-A in FIG. 8A.

Furthermore, at least a part of the through hole 25 of the leg fitting projection 23, that is, an inner portion 25*a* on the longitudinal direction center side of the through hole 25, for example, is positioned further inward in a radial direction than a virtual cylindrical surface K along the cylindrical-surface-shaped outer peripheral surface of the movable body main body part 21 (see FIG. 7, FIG. 8A and FIG. 8B). Note that the virtual cylindrical surface K is a virtual cylindrical surface positioned along an outer peripheral surface of a first main body portion 26 (portion where no recessed groove 28 is formed) and an outer peripheral surface of a second main body portion 27 (portion where no plane surface 29 is formed) described later.

Meanwhile, the movable body main body part 21 has the cylindrical first main body portion 26 positioned further upward than the leg fitting projections 23, and the substantially triangular cylindrical second main body portion 27 positioned further downward than the leg fitting projections 23. The first main body portion 26 is a part grabbed by a user (an operator) with fingers when moving the movable body 6 relative to the support column 4. On the outer peripheral surface of the first main body portion 26, there are formed a number of recessed grooves 28 to prevent slip of fingers.

Moreover, the second main body portion 27 has, on the outer peripheral surface thereof, three plane surfaces 29 proximate to and facing plane surface portions 40 of the leg parts 41 of the leg bodies 8 when the music stand 1 is not used (when folded). Such three plane surfaces 29 are arranged in a circumferential direction with gaps put in a circumferential direction of the second main body portion 27 so as to correspond to the three leg fitting projections 23, and an arc surface 30 is formed between the mutually adjacent plane surfaces 29. That is, the outer peripheral surface of the second main body portion 27 is constituted by the three plane surfaces 29 and the three arc surfaces 30 positioned therebetween.

The fixed body 7 has a bottomed cylindrical fixed body main body part 31 having an open upper surface, and the fixed body main body part 31 is fitted and fastened to the lower end portion of the tubular member 16 of the lowest stage of the support column 4. Moreover, three connection projections 32 arranged in a circumferential direction are provided integrally to project on the lower part of the fixed body main body part 31.

The leg body 6 has a leg part 41 having a rectangular section and formed to be longitudinal with a given length. Then, when the music stand 1 is not used, a contact portion 42 around a lower end of the leg part 41 is in contact with the connection projection 32 of the fixed body 7 which restricts rotation to a closing direction, and the leg part 41 is positioned in parallel to the support column 4. Moreover, when in this state, that is, in the state where the leg body 8 is positioned in a folded position, the plane surface portion 40 on the upper end side of the leg part 41 is proximate to (including touching and not touching) and faces the plane surface 29 of the corresponding movable body main body part 21 (see FIG. 5).

Figure 5:
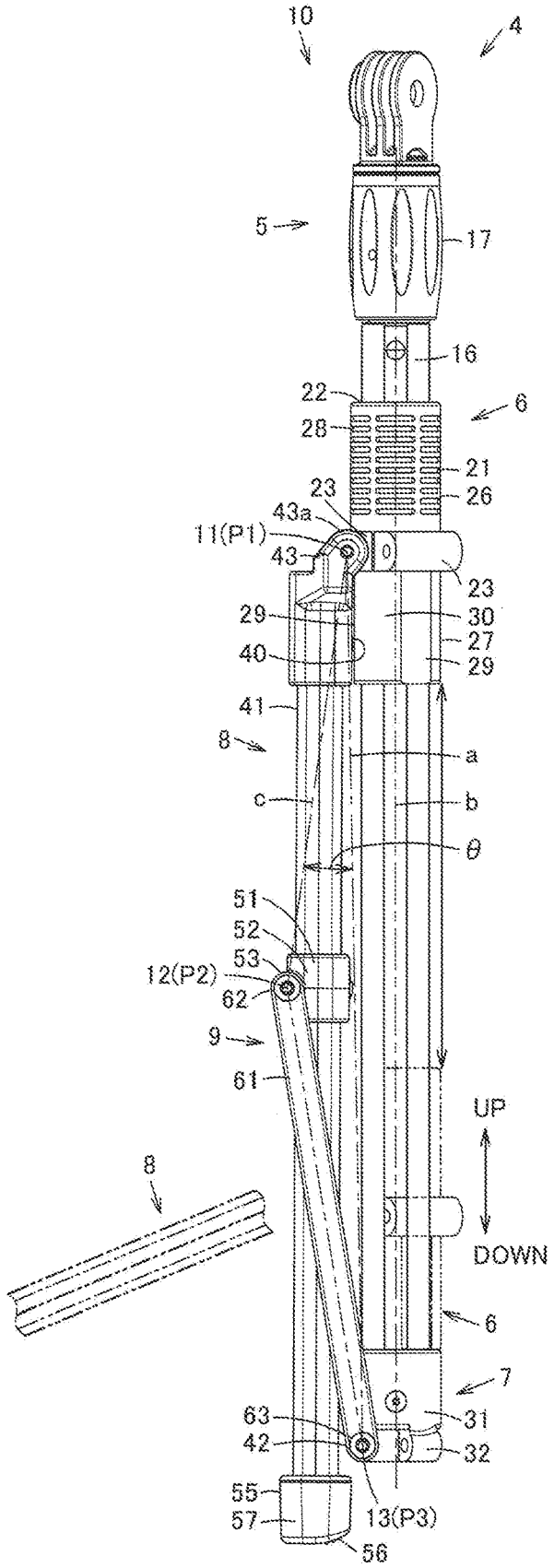
FIG. 5 is a front view of the partially omitted tripod of the music stand (when it is not used).
Figure 6:
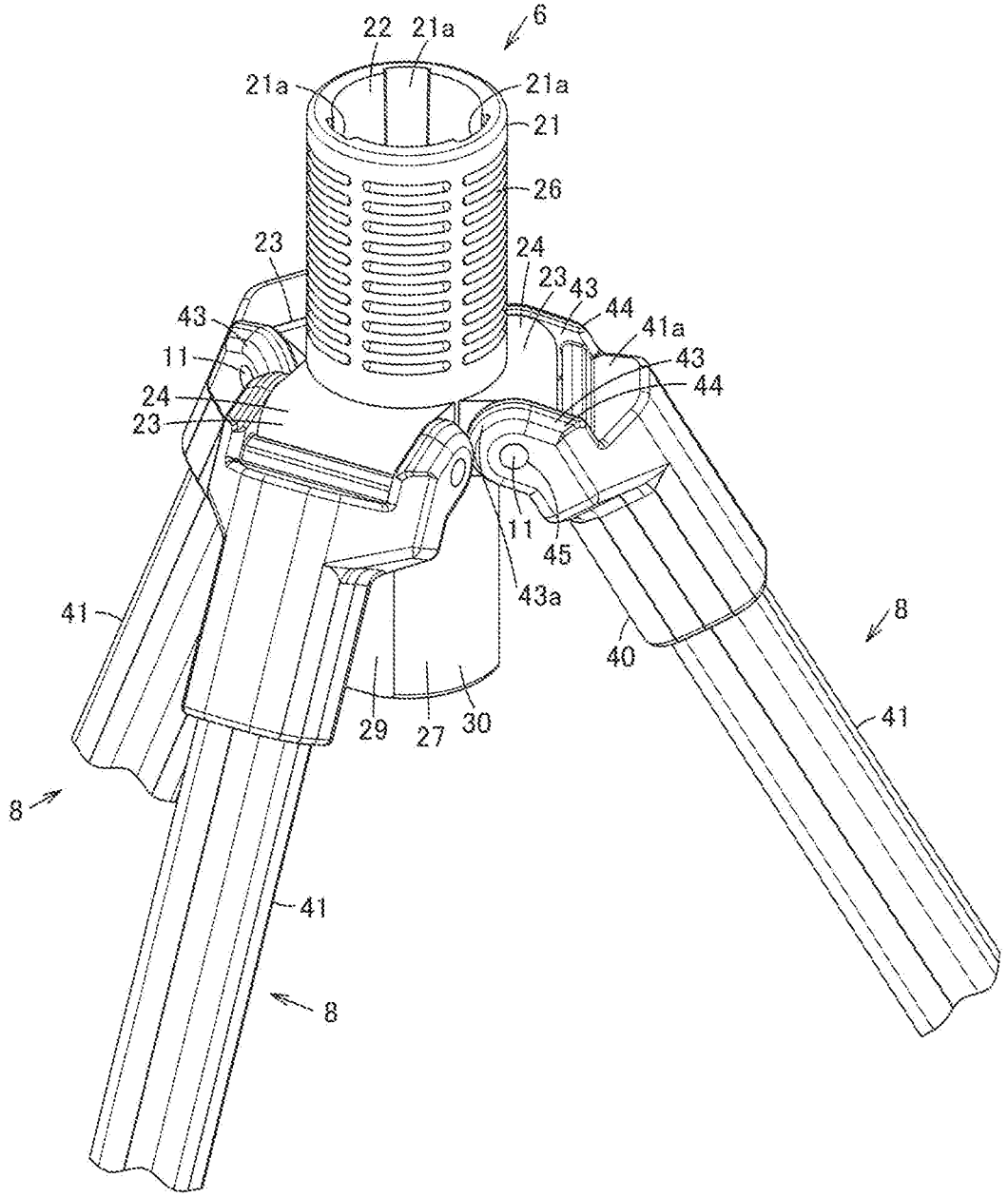
FIG. 6 is a main port perspective view of the music stand.

Note that as illustrated by a two-dot chain line in FIG. 5, in a state where the leg body 8 is positioned in a maximum opening position (position with which an inclination angle of the leg body is maximum relative to a vertical direction) when the music stand 1 is used, a lower surface of the movable body 6 is in contact with an upper surface of the fixed body 7. In other words, the lower surface of the movable body 6 is in contact with the upper surface of the fixed body 7, which restricts rotation of the leg body 8 to an opening direction.

Moreover, on the upper end portion of the leg part 41, there are provided to project upward plate-shaped facing portions 43 separately facing each other to form a pair, with the leg fitting projection 23 interposed (with a given distance corresponding to the leg fitting projection 23 interposed, for example). That is, one pair of the facing portions 43 project diagonally upward from an upper surface 41*a* of the leg part 41, and the leg fitting projection 23 is disposed between such both facing portions 43. The facing portion 43 includes an axis penetration hole 45 having a circular section and extending in a plate thickness direction to go through the facing portion 43. Moreover, an inclination surface 44 is formed on a peripheral edge side of an outer surface of the facing portion 43. Furthermore, the facing portion 43 has, on the tip side thereof, a substantially semicircular fitting portion 43*a* corresponding to the section shape of the leg fitting projection 23, and the axis penetration hole 45 is formed on the fitting portion 43*a*.

Then, the leg fitting projection 23 is fitted between the fitting portions 43*a* of both the facing portions 43 of the leg part 41, whereby the through hole 25 and both the axis penetration holes 45 are arranged on a straight line to communicate with each other. The round-axis-shaped rotation center axis (pin) 11 is penetrated in and fixed to each of the holes 25, 45 that communicate. In this manner, the fitting portion 43*a* of both the facing portions 43 at the upper end portion of each of the leg bodies 8 is fitted to the leg fitting projection 23 of the movable body 6 through the rotation center axis 11 to be rotatable with the rotation center axis 11 as a center.

Note that space 46 with a given size exists between the inclination surface 44 of the facing portion 43 on one side of one leg body 8 of both the mutually adjacent leg bodies 8 and the inclination surface 44 of the facing portion 43 on one side of the other leg body 8 (see FIG. 7). However, the space 46 may not exist. In other words, the inclination surface 44 of the facing portion 43 on the side of one of both the facing portions 43 of one leg body 8 is constantly proximate to (including touching and not touching) and facing the inclination surface 44 of the facing portion 43 on the side of the other of both the facing portions 43 of the leg body 8 different to the above-described one leg body 8.

Meanwhile, the leg body 8 has a substantially square-cylindrical cylindrical member 51 fastened to a longitudinal direction center part that is a longitudinal direction intermediate part of the leg part 41. This cylindrical member 51 is constituted by a square-cylindrical cylindrical part 52 to which the leg part 41 is inserted and fixed, and a connection projection 53 provided integrally to project outward on the outer surface side of the cylindrical part 52 (opposite side to the side facing the support column 4).

Moreover, the leg body 8 has a ferrule member 55 fastened to a lower end portion of the leg part 41. The ferrule member 55 is constituted by a ferrule portion 57 with a substantially arc-shaped contact surface 56 formed thereon and placed on the placement surface S, and a fitting part 58 provided integrally to the ferrule portion 57 and fitted and fixed inside the lower end portion of the leg part 41.

The connection body 9 connects the fixed body 7 and the leg body 8, and has an elongate plate-shaped longitudinal part 61 having a given length shorter than the leg part 41. One-end-side connection portion 62 is provided integrally to one end portion (upper end portion) of the longitudinal part 61, while an other-end-side connection portion 63 is provided integrally to the other end portion (lower end portion) of the longitudinal part 61.

Then, the one-end-side connection portion 62 of the connection body 9 is connected to the connection projection 53 of the cylindrical member 51 of the leg body 8 through the rotation center axis 12 to be rotatable with the rotation center axis 12 as a center. That is, the one-end-side connection portion 62 positioned on one end side of the connection body 9 is connected to be rotatable to a portion on the opposite side to the side facing the support column 4 of the support body 5 in the cylindrical member 51 of the leg body 8. Moreover, the other-end-side connection portion 63 of the connection body 9 is connected to the connection projection 32 of the fixed body 7 through the rotation center axis 13 to be rotatable with the rotation center axis 13 as a center.

Here, as illustrated in FIG. 5, when the music stand 1 is not used (that is, when the leg body 8 is positioned in a folded position), a straight line a linking the rotation fulcrum P1 between the movable body 6 and the leg body 8 and the rotation fulcrum P3 between the fixed body 7 and the connection body 9 is positioned substantially parallel (and may be parallel) to an axial core line (vertical line passing a center point O of the insertion hole 22 of the movable body 6) b of the support column 4.

Moreover, when in such a state, the rotation fulcrum P2 between the leg body 8 and the connection body (transmission rod) 9 is not positioned on the straight line a but at a position deviating to the opposite side to an axial core line b side relative to the straight line a. Furthermore, an angle θ formed by a straight line c connecting the rotation fulcrum P1 and the rotation fulcrum P2 and the straight line a is equal to or smaller than 10°, for example, and is preferably about 8°. Then, such a positional relation of the rotation fulcrums allows the movable body 6 to move (slide) smoothly along the outer peripheral surface of the support column 4 and in conjunction with such movement of the movable body 6, the leg body 8 rotates in an opening-closing direction.

The following describes the actions of the music stand 1, or the like.

When the music stand 1 is used, a user switches the music stand 1 of the folded nonuse state to the desired use state, and places the music stand 1 on the placement surface S.

Figures 10A, 10B, 10C, 10D, 10E:
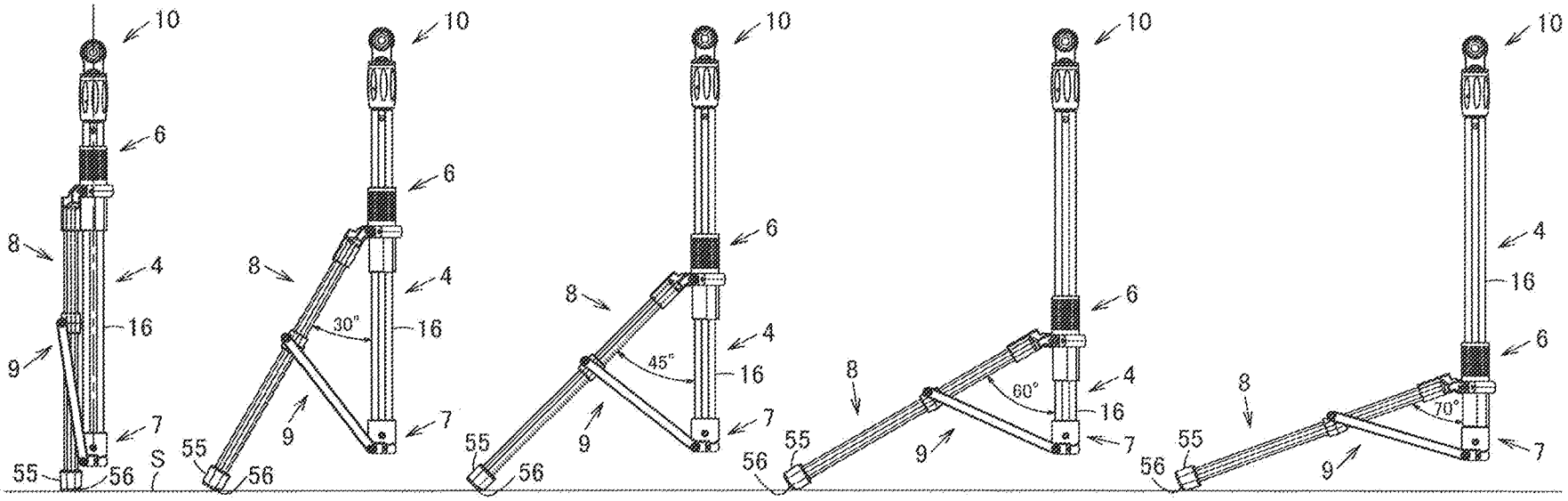
FIGS. 10A, 10B, 10C, 10D and 10E are diagrams explaining rotation of a leg body.

That is, the user moves the movable body 6 downward relative to the support column 4 (the column part of the support body 5) from the nonuse state (folded state) illustrated in FIG. 10A, so as to simultaneously rotate the three leg bodies 8 of the tripod 10 in an opening direction with the rotation center axis 11 as a center and open them.

Here, as illustrated in FIGS. 10B, 10C, 10D and 10E, a stopper for fixing legs is not provided. The leg body 8 can be set with an arbitrary inclination angle (maximum angle is 70°, for example) without the stopper.

Moreover, as illustrated in FIG. 1, the user extends the support column 4 by a desired amount to adjust a height position of the music support frame 3, and subsequently expands the music support frame 3. Then, the user places the music 2 of a musical score or the like on the music support frame 3 of the support body 5.

In this manner, the user can set the music stand 1 in a desired use state so as to use it.

Then, in the case of restoring the music stand 1 to the original nonuse state after using it, the user folds the expanded music support frame 3 and contracts and shortens the support column 4.

Moreover, the user moves the movable body 6 upward relative to the support column 4 until it becomes the state illustrated in FIG. 10A, so as to simultaneously rotate the three leg bodies 8 of the tripod 10 in a closing direction with the rotation center axis 11 as a center and close them. As a result, the three leg bodies 8 become a state parallel to the support column 4 in the center, and the music stand 1 becomes compact nonuse state as a whole.

Then, according to such a music stand 1, operability is preferable, and the user can significantly easily operate the music stand 1. That is, by only operating to move the movable body 6, the user can open and close the three leg bodies 8 easily, like opening and closing an umbrella.

Moreover, the compactness when folded is also preferable, and when the music stand 1 is not used when carrying or the like, the music stand 1 can be made to be in the compact nonuse state. Especially, because of the fact that the distance A between the longitudinal direction center part of the through hole 25 and the insertion hole 22 is shorter than the thickness B of a given portion of the movable body main body part 21, the fact that the longitudinal direction length dimension L or the through hole 23 is longer than the diameter D of the insertion hole 22, or the like, it is possible to make the tripod 10 of the music stand 1 compact while securing the necessary strength of the movable body 6.

Note that the music stand 1 is not limited to the structure having three leg bodies 8. The number of leg bodies 8, connection bodies 9, or the like, is arbitrary and preferably at least three.

In addition, the support device is not limited to the music stand 1 supporting the music 2 as a supported object, and, for example, may support a camera, a video camera, a luminaire, a measurement device, a cellular phone, or the like as a supported object.

REFERENCE SIGNS LIST

1 music stand as support device
2 music as supported object
5 support body
6 movable body
7 fixed body
8 leg body
9 connection body
11 rotation center axis
21 movable body main body part
22 insertion hole
23 leg fitting projection
25 through hole
29 plane surface
41 leg part
43 facing portion
45 axis penetration hole
51 cylindrical member
A distance
B thickness
L length dimension
D diameter
K virtual cylindrical surface

What is claimed is:

1. A support device comprising:
a support body that supports a supported object;
a movable body that is provided at the support body to be movable;
a fixed body that is provided at the support body;
a plurality of leg bodies that are fitted to the movable body to be rotatable with a rotation center axis as a center; and
a plurality of connection bodies with one end side connected to the leg body to be rotatable and other end side connected to the fixed body to be rotatable, wherein
the movable body includes
a movable body main body part having an insertion hole formed therein with the support body inserted in the insertion hole, and
a leg fitting projection provided on the movable body main body part and having a through hole formed therein,
the leg body includes
a longitudinal leg part, and
facing portions provided at an upper end portion of the leg part to project diagonally upward to a side of the movable body, having an axis penetration hole formed therein, and separately facing each other with the leg fitting projection interposed,
the rotation center axis is penetrated in the through hole of the leg fitting projection and the axis penetration hole of each of the facing portions, and
the facing portion on one side of one leg body of the mutually adjacent leg bodies and the facing portion on one side of other leg body are constantly proximate to face each other.

2. The support device according to claim 1, wherein a distance between a longitudinal direction center part of the through hole of the leg fitting projection and the insertion hole of the movable body main body part is shorter than a thickness of a portion of the movable body main body part neighboring to the leg fitting projection in a peripheral direction.

3. The support device according to claim 1, wherein a longitudinal direction length dimension of the through hole of the leg fitting projection is longer than a diameter of the insertion hole of the movable body main body part.

4. The support device according to claim 1, wherein at least a part of the through hole of the leg fitting projection is positioned further inward in a radial direction than a virtual cylindrical surface along an outer peripheral surface of the movable body main body part.

5. The support device according to claim 1, wherein the leg fitting projection is formed to be in a substantially semicylindrical shape with a substantially semicircular cross section.

6. The support device according to claim 1, wherein the movable body main body part includes a plane surface proximate to and facing the leg part of the leg body in a nonuse state, and
the plane surface is formed at a portion corresponding to the leg fitting projection in the outer peripheral surface of the movable body main body part.

7. The support device according to claim 1, wherein the leg body includes a cylindrical member fastened to a longitudinal direction intermediate part of the leg part, and the one end side of the connection body is connected to a portion on an opposite side to a side facing the support body in the cylindrical member to be rotatable.

8. The support device according to claim 1, wherein the support device is a music stand supporting a music as the supported object.

9. A support device comprising:

a support body that supports a supported object;

a movable body that is provided at the support body to be movable;

a fixed body that is provided at the support body;

a leg body that is fitted to the movable body to be rotatable; and a connection body with one end side connected to the leg body to be rotatable and other end side connected to the fixed body to be rotatable, wherein one end side of the connection body is connected to a portion on an opposite side to a side facing the support body in a cylindrical member fastened to a longitudinal direction intermediate part of the leg body to be rotatable.

10. A support device comprising:

a support body that supports a supported object;

a movable body that is provided at the support body to be movable;

a fixed body that is provided at the support body;

a plurality of leg bodies that are fitted to the movable body to be rotatable; and a plurality of connection bodies with one end side connected to the leg body to be rotatable and other end side connected to the fixed body to be rotatable, wherein the movable body includes a movable body main body part having an insertion hole formed therein with the support body inserted in the insertion hole, and a leg fitting projection projected on the movable body main body part, the leg body includes a longitudinal leg part, facing portions provided at the leg bodies, separately facing each other with the leg fitting projection interposed, and rotating with respect to the leg fitting projection, and the facing portion on one side of one leg body of the mutually adjacent leg bodies and the facing portion on one side of other leg body are constantly proximate to face each other.

* * * * *